US010400538B2

(12) United States Patent
Roesner

(10) Patent No.: US 10,400,538 B2
(45) Date of Patent: Sep. 3, 2019

(54) METHOD AND APPARATUS FOR HYDRAULIC FRACTURING

(71) Applicant: Cameron International Corporation, Houston, TX (US)

(72) Inventor: Thomas G. Roesner, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 180 days.

(21) Appl. No.: 15/476,561

(22) Filed: Mar. 31, 2017

(65) Prior Publication Data

US 2017/0204714 A1 Jul. 20, 2017

Related U.S. Application Data

(63) Continuation-in-part of application No. 15/152,370, filed on May 11, 2016, now Pat. No. 10,107,062.

(60) Provisional application No. 62/317,094, filed on Apr. 1, 2016, provisional application No. 62/188,621, filed on Jul. 3, 2015.

(51) Int. Cl.

| | |
|---|---|
| ***E21B 33/068*** | (2006.01) |
| ***E21B 33/03*** | (2006.01) |
| ***E21B 43/26*** | (2006.01) |

(52) U.S. Cl.

CPC ..... *E21B 33/068* (2013.01); *E21B 33/03* (2013.01); *E21B 43/26* (2013.01)

(58) Field of Classification Search

CPC ..... E21B 33/068; E21B 43/26; E21B 33/03
See application file for complete search history.

(56) References Cited

U.S. PATENT DOCUMENTS

| | | | | |
|---|---|---|---|---|
| 5,012,865 | A | 5/1991 | McLeod | |
| 8,122,949 | B2 | 2/2012 | Cherewyk | |
| 9,297,237 | B2 | 3/2016 | Lunde et al. | |
| 9,540,898 | B2 | 1/2017 | Hughes | |
| 2003/0221838 | A1 | 12/2003 | Dallas | |
| 2005/0056420 | A1 | 3/2005 | Ramey et al. | |
| 2008/0035326 | A1 | 2/2008 | Cherewyk | |
| 2009/0145597 | A1 | 6/2009 | Cherewyk | |
| 2013/0306304 | A1* | 11/2013 | Cherewyk | E21B 43/26 166/90.1 |
| 2014/0034328 | A1 | 2/2014 | Smith et al. | |
| 2014/0096950 | A1* | 4/2014 | Pyecroft | E21B 43/26 166/247 |

OTHER PUBLICATIONS

"Coil Tubing Frac Head," Stinger Wellhead Protection (Canada) Inc., http://www.oilstatesintl.com/stinger/canada/products/ca_coiltubing.html, (2010).

(Continued)

*Primary Examiner* — Brad Harcourt
(74) *Attorney, Agent, or Firm* — Fletcher Yoder, P.C.

(57) ABSTRACT

A method for fracking a well includes inserting a downhole tool into the well via a conveyance string through a wellhead assembly having a wellhead bore. The method also includes surrounding, at least partially, the conveyance string with a sleeve that at least extends below a portion of an inlet of the wellhead assembly, wherein the inlet intersects the wellhead bore. The method further includes injecting pressurized fluid into the well via the inlet of the wellhead assembly while retrieving the downhole tool from the well.

20 Claims, 13 Drawing Sheets

(56) References Cited

OTHER PUBLICATIONS

PCT International Search Report and Written Opinion for Application No. PCT/US2016/039028 dated Oct. 10, 2016, 15 pages.
PCT International Search Report & Written Opinion for PCT Application No. PCT/US2017/025561 dated Jun. 16, 2017; 13 Pages.

* cited by examiner

METHOD AND APPARATUS FOR HYDRAULIC FRACTURING

CROSS-REFERENCE TO RELATED APPLICATIONS

This application is a continuation-in-part of U.S. application Ser. No. 15/152,370, filed May 11, 2016, entitled "FRAC HEAD SYSTEM," which claims priority from and the benefit of U.S. Provisional Application No. 62/188,621, filed Jul. 3, 2015, entitled "FRAC HEAD SYSTEM." This application also claims priority from and the benefit of U.S. Provisional Application No. 62/317,094, filed Apr. 1, 2016, entitled "METHOD AND APPARATUS FOR HYDRAULIC FRACTURING." U.S. application Ser. No. 15/152,370, U.S. Provisional Application No. 62/188,621, and U.S. Provisional Application No. 62/317,094 are hereby incorporated by reference herein in their entirety for all purposes.

FIELD OF THE INVENTION

The present invention relates generally to frac heads.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are frequently used to extract resources, such as oil and gas, from subterranean reserves. These resources, however, can be difficult to extract because they may flow relatively slowly to the well bore. Frequently, a substantial portion of the resources is separated from the well by bodies of rock and other solid materials. These solid formations impede fluid flow to the well and tend to reduce the well's rate of production.

In order to release more oil and gas from the formation, the well may be hydraulic fractured. Hydraulic fracturing involves pumping a frac fluid that contains a combination of water, chemicals, and proppant (e.g., sand, ceramics) into a well at high pressures. The high pressures of the fluid increases crack size and crack propagation through the rock formation, which releases more oil and gas, while the proppant prevents the cracks from closing once the fluid is depressurized. Unfortunately, the high-pressures and abrasive nature of the frac fluid may wear components.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

The present embodiments disclose a frac head system with an isolation sleeve that protects a tubing during hydraulic fracturing operations. As will be explained below, some hydraulic fracturing operation may use a downhole tool controlled by a tubing that aligns the downhole tool with a natural resource formation. For example, the tubing may push and/or pull the downhole tool through a wellbore. Once the downhole tool is aligned with the formation, the downhole tool plugs the wellbore and cuts through a casing that lines the wellbore. Frac fluid may then be pumped into the wellbore to hydraulically fracture the formation. As frac fluid is pumped into the frac head it may flow at high velocities. As explained above, frac fluid contains abrasive materials that can wear components. In order to protect the tubing from frac fluid moving at high velocities, the frac head system includes an isolation sleeve in a frac head. As will be explained below, the isolation sleeve may have wear resistant features that increase the durability of the isolation sleeve. Furthermore, in the event that a portion of the isolation sleeve separates from the rest of the isolation sleeve, the isolation sleeve and frac head may block those portions that separate from entering the wellbore.

Figure 1:
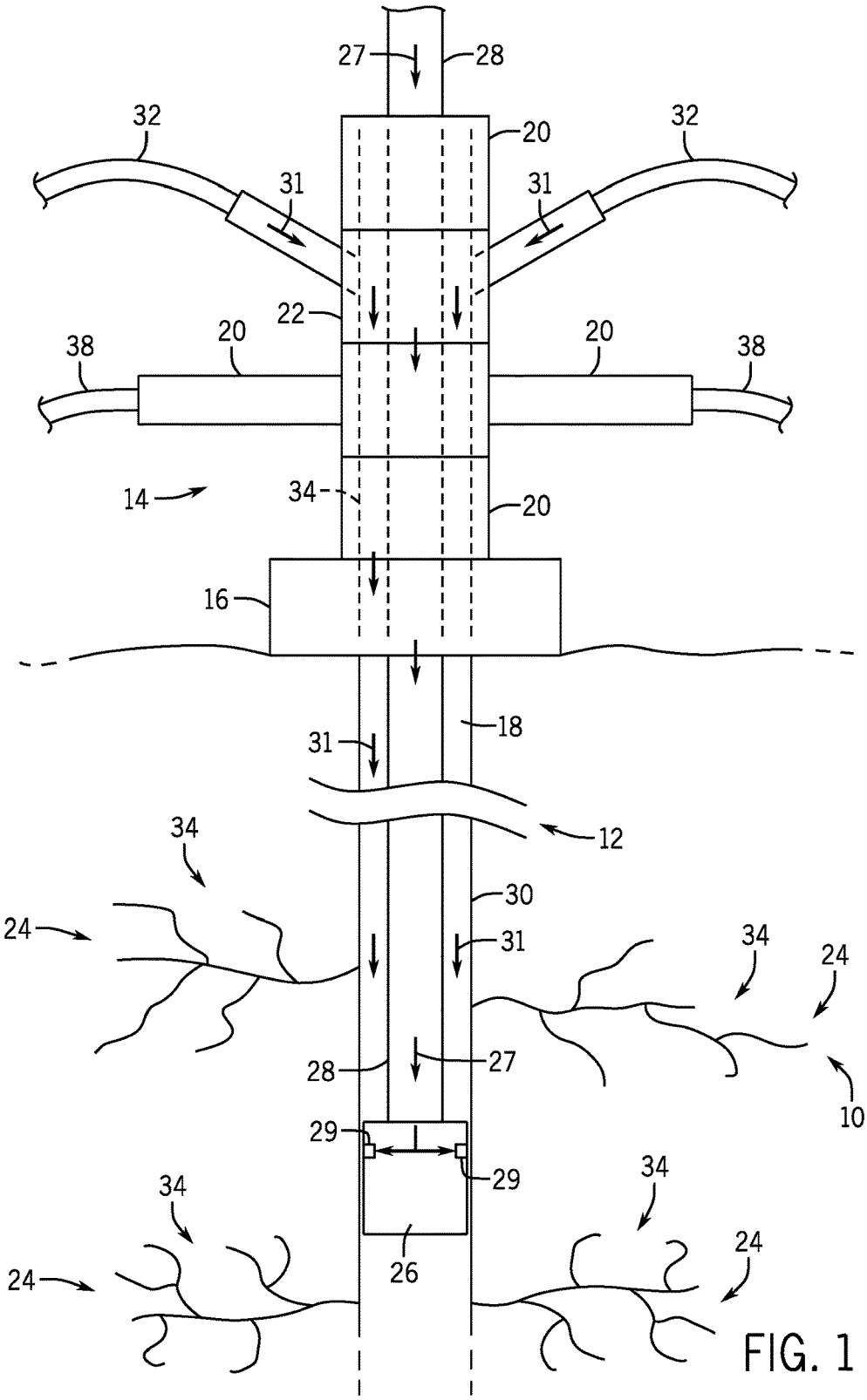
FIG. 1 is a block diagram of an embodiment of a hydrocarbon extraction system.

FIG. 1 is a block diagram that illustrates an embodiment of a hydrocarbon extraction system 10 capable of hydraulically fracturing a well 12 to extract various minerals and natural resources (e.g., oil and/or natural gas). The system 10 includes a frac tree 14 coupled to the well 12 via a wellhead hub 16. The wellhead hub 16 generally includes a large diameter hub disposed at the termination of a well bore 18 and is designed to connect the frac tree 14 to the well 12. The frac tree 14 may include multiple components such as valves 20 and a frac head system 22 that enable and control fluid flow into and out of the well 12. For example, the frac tree 14 may route oil and natural gas from the well 12, regulate pressure in the well 12, and inject chemicals into the well 12.

As illustrated, the well 12 may have multiple formations 24 at different points. In order to access each of these formations (e.g., hydraulically fracture) in a single run, the hydrocarbon extraction system may use a downhole tool 26 coupled to a tubing 28 (e.g., coiled tubing, conveyance tubing). In operation, the tubing 28 pushes and pulls the downhole tool 26 through the well 12 to align the downhole tool 26 with each of the formations 24. Once the tool 26 is in position, the tool 26 prepares the formation to be hydraulically fractured by plugging the well 12 and boring through the casing 30. For example, the tubing 28 may carry a pressurized cutting fluid 27 that exits the downhole tool 26 through cutting ports 29. After boring through the casing 30, the hydrocarbon extraction system 10 pumps frac fluid 31 (e.g., a combination of water, proppant, and chemicals) through conduits 32 and into the frac head system 22. The frac head system 22 guides the frac fluid 31 into a bore 34 in the frac tree 14, which then conduits the frac fluid 31 into the well bore 18. As will be explained in detail below, the frac head system 22 protects (e.g., reduces wear) the tubing 28 from the frac fluid 31 as it enters the bore 34.

As the frac fluid 31 pressurizes the well 12, above the downhole tool 26, the frac fluid 31 fractures the formations 24 releasing oil and/or natural gas by propagating and increasing the size of cracks 36. Once the formation 24 is hydraulically fractured, the hydrocarbon extraction system 10 depressurizes the well 12 by reducing the pressure of the frac fluid 31 and/or releasing frac fluid 31 through some of the valves 20 (e.g., wing valves). For example, the valves 20 may open enabling frac fluid 31 to exit the frac tree 14 through the conduits 38. The hydrocarbon extraction system 10 may then repeat the process by moving the downhole tool 26 to the next formation 24 with the tubing 28.

Figure 2:
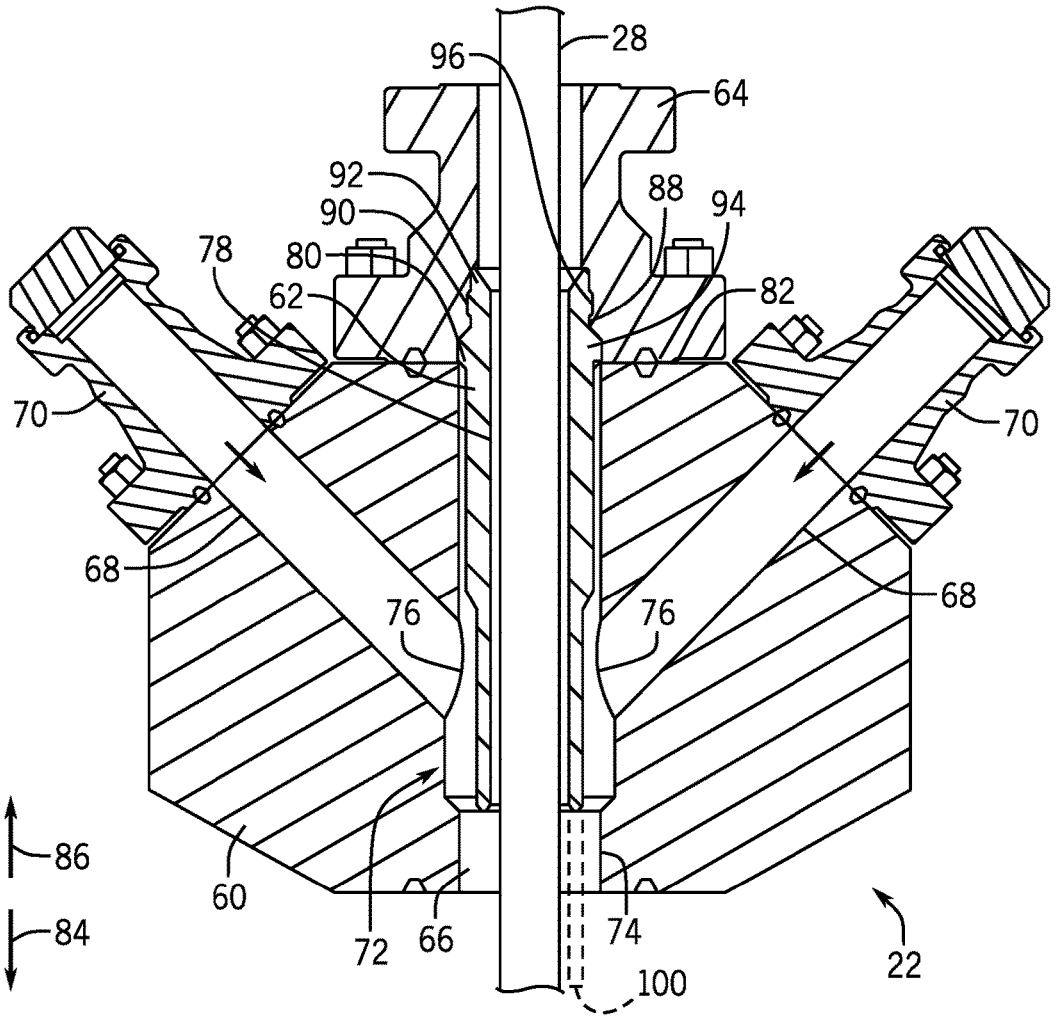
FIG. 2 is a cross-sectional view of an embodiment of a frac head system.

FIG. 2 is a cross-sectional view of an embodiment of a frac head system 22. In some embodiments, the frac head system 22 includes a frac head 60 (colloquially called a goat's head), an isolation sleeve 62, and an adapter spool 64. As illustrated, the isolation sleeve 62 rests within a bore 66 of the frac head 60. The bore 66 forms part of the bore 34 that enables the tubing 28 to extend through the frac tree 14 and into the well 12. The bore 66 in turn fluidly communicates with one or more frac passages 68 (e.g., 1, 2, 3, 4, or more) that enable frac fluid 31 to be pumped into the frac head 60 through connectors 70. The connectors 70 in turn couple to the conduits 32, seen in FIG. 1, that carry frac fluid 31 from a frac source. As the frac fluid 31 passes through the frac passages 68 and enters the bore 66, the frac fluid 31 may increase in velocity because of the pressure differential between the pressure of the frac fluid 31 in the frac passages 68 and the pressure in the bore 66. For example, there may limited space 72 between the tubing 28 and the outlets 76 of the frac passages 68. Accordingly, the frac head system 22 includes the isolation sleeve 62 to protect the tubing 28 from wear caused by frac fluid 31 entering the bore 66.

As illustrated, the isolation sleeve 62 rests in the bore 66 and includes a passage 78 (e.g., tubing bore) that enables the tubing 28 to pass through the frac head system 22. The isolation sleeve 62 may be held in place using threads, bolts, and/or a flange 80. For example, the flange 80 may extend over a top surface 82 of the frac head 60 blocking axial movement of the isolation sleeve 62 in direction 64. In order to block axial movement in direction 86, the frac head system 22 may include the adapter spool 64 that bolts to the frac head 60. The adapter spool 64 includes a counterbore 88 that receives the flange 80 and blocks axial movement of the isolation sleeve 62 in axial direction 86. In some embodiments, the isolation sleeve 62 may include threads 90 in a top portion 94 that couple to threads 96 in the adapter spool 64. In addition to retaining the isolation sleeve 62 in the frac head 60, the adapter spool 64 enables additional components of the hydrocarbon extraction system 10 to couple to the frac tree 14. For example, the adapter spool 64 may enable a blowout preventer (BOP), gate valve, lubricator, crossover, side door stripper, and injector head to couple to the frac tree 14.

In operation, the isolation sleeve 62 blocks wear of the tubing 28 by extending over a portion of the tubing 28. More specifically, the isolation sleeve 62 includes a portion 98 (e.g., protection portion) that extends over the outlets 76 of the frac passages 68. The portion 98 blocks direct contact between the frac fluid 31 and the tubing 28 as the frac fluid 31 exits the frac passages 68. In this way, the isolation sleeve 62 reduces wear of the tubing 28 during hydraulic fracturing operations. Furthermore, the portion 98 may have a uniform thickness 100; instead of being tapered. By including a uniform thickness instead a tapered thickness the isolation sleeve 62 blocks or reduces opportunities for parts of the isolation sleeve 62 to wear and separate from the isolation sleeve 62.

Figure 3:
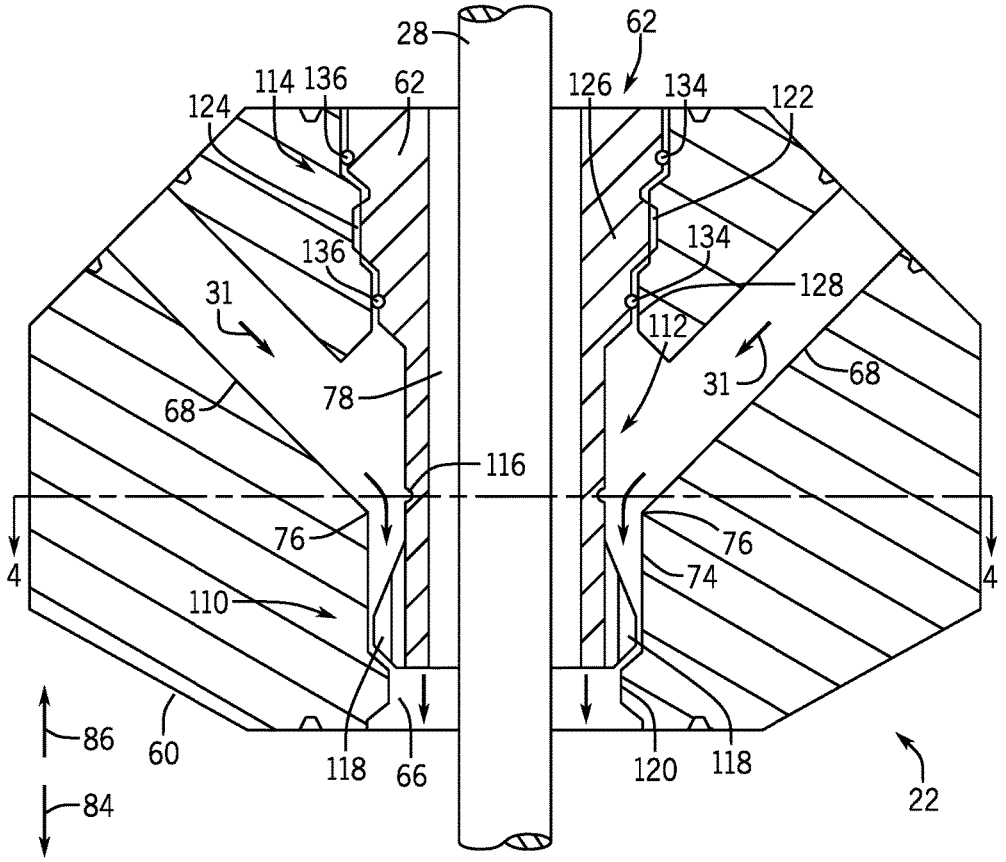
FIG. 3 is a cross-sectional view of an embodiment of a frac head system.

FIG. 3 is a cross-sectional view of an embodiment of a frac head system 22 with an isolation sleeve 62. The isolation sleeve 62 includes a first portion 110, a middle or second portion 112 (e.g., protection portion), and a third portion 114. As illustrated, the middle portion 112 extends over the outlets 76 of the frac passages 68 to block direct contact between the frac fluid 31 and the tubing 28 as the frac fluid 31 exits the frac passages 68. In this way, the isolation sleeve 62 reduces wear on the tubing 28 during hydraulic fracturing operations. However, overtime the frac fluid 31 may wear the middle portion 112 of the isolation sleeve 62 enabling frac fluid 31 to pass through the isolation sleeve 62 and/or enabling the first portion 110 to separate from the rest of the isolation sleeve 62. In order to monitor wear of the middle portion 112, the middle portion 112 may include one or more wear indicators 116 (e.g., grooves). The wear indicator 116 enables a user to monitor wear and thus replace the isolation sleeve 62 when the isolation sleeve 62 reaches a wear threshold. Moreover, in some embodiments, the isolation sleeve 62 may include one or more protrusions 118 (e.g., 1, 2, 3, 4, or more) that extend radially from the first portion 110. These protrusions 118 may rest on corresponding ledges 120 (e.g., landings, circumferential lip) of the frac head 60 that extend radially inward into the bore 66. In operation, the ledges or landings 120 may act as a failsafe that blocks the lower portion 110 from falling into the well 12 if the lower portion 110 separates from the middle portion 112 during use.

As illustrated, the isolation sleeve 62 may couple to the frac head 60 with the third portion 114. For example, the third portion 114 may include threads 122 that threadingly engage threads 124 on the frac head 124. In some embodiments, the third portion 114 may include a lip 126 (e.g., circumferential) that rests on a landing 128 (e.g., circumferential) of the frac head 60 to block axial movement of the isolation sleeve 62 in axial direction 84. In still other embodiments, the isolation sleeve 62 may include both the threads 122 and the lip 162. In order to block fluid flow around the isolation sleeve 62 in axial direction 86, the isolation sleeve 62 and/or frac head 60 may include seals 134 (e.g., circumferential) that rest within grooves 136 (e.g., circumferential).

Figure 4:
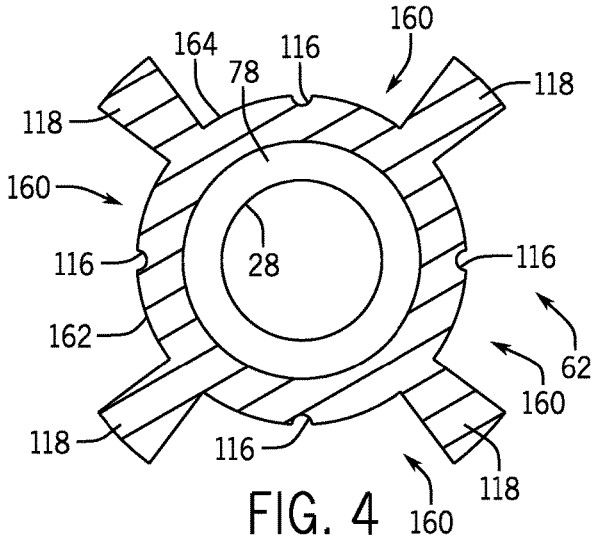
FIG. 4 is a cross-sectional view of an embodiment of an isolation sleeve along line 4-4 of FIG. 3.

FIG. 4 is a cross-sectional view of an embodiment of an isolation sleeve along line 4-4 of FIG. 3. As illustrated, the isolation sleeve 62 includes multiple protrusions 118 that extend radially outward to form flutes or passages 160 that enable frac fluid 31 to flow between the frac head 60 and an outer surface 162 of the isolation sleeve. As explained above, the isolation sleeve 62 may include one or more of these protrusions 118 (e.g., 1, 2, 3, 4, or more). For example, the frac head 60 may include multiple frac fluid passages 68, and each of these frac fluid passages 68 may direct fluid flow into a respective flute 160. Moreover, in order to monitor wear from frac fluid 31 flowing through separate frac fluid passages 68, the isolation sleeve 62 may have a corresponding wear indicator 116. The different wear indicators 116 may enable detection of varying wear of the isolation sleeve 62 about the circumference 164. This information may enable adjustment of the hydrocarbon extraction system 10 ensuring that the frac fluid 31 is pumped through each of the frac passages 68 in substantially equal amounts and with substantially equal pressures.

Figure 5:
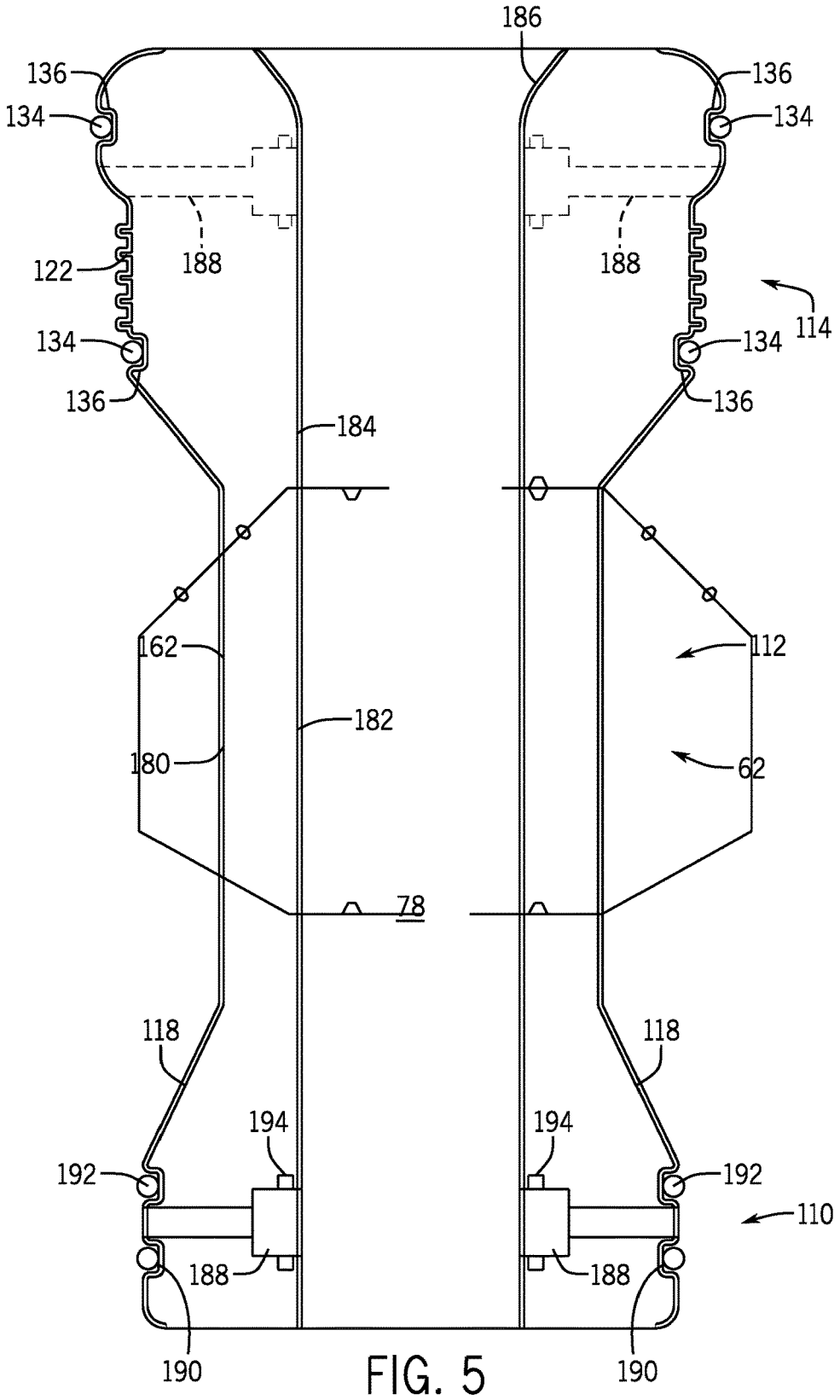
FIG. 5 is a cross-sectional view of an embodiment of an isolation sleeve.

FIG. 5 is a cross-sectional view of an embodiment of an isolation sleeve 62. In some embodiments, the isolation sleeve 62 may include coatings that reduce wear and friction during fracing operations. For example, the outer surface 162 of the isolation sleeve 62 may include a wear resistant coating (e.g., tungsten carbide) and/or be treated with a surface treatment 180 (e.g., shot peening). In operation, the wear resistance coating and/or treatment 180 (e.g., wear resistance feature) increases the wear resistance of the isolation sleeve 62 against the flow of frac fluid 31. In some embodiments, the interior surface 182 may also include a coating 184 (e.g., coating and/or surface treatment). However, instead of a wear resistance coating or treatment the interior coating 184 may be a friction reducing coating and/or treatment that facilitates movement of the tubing 28 through the passage 78. The interior surface 182 may also include a curved or angled edge 186 (e.g., circumferential) that guides the tubing 28 into and through the passage 78.

In some embodiments, the isolation sleeve 62 may enable coupling to the frac head 60 using fasteners (e.g., bolts, screws, etc.). For example, the isolation sleeve 62 may include radial apertures 188 in the first portion 110 that enable the first portion 110 to couple to the frac head 60 or another component in the frac tree 14 (e.g., a spool, valve, etc,) with fasteners. In order to protect the fasteners from frac fluid 31, the first portion 110 may include seals 192 that rest in grooves 190 that extend circumferentially about apertures 188. In some embodiments, the apertures 188 may include a retaining ring groove 194 that receives a retaining ring (e.g., snap ring, c-ring). In operation, the retaining rings block removal of the fasteners. Similarly, the third portion 114 may include apertures 188 that enable the isolation sleeve 62 to couple to the frac head 60 or another component in the frac tree 14 (e.g., a spool, valve, etc,). Accordingly, the isolation sleeve 60 may be secured to the frac head 60 and/or other components of the frac tree 14 using the first portion 110 and/or the third portion 114.

Figure 6:
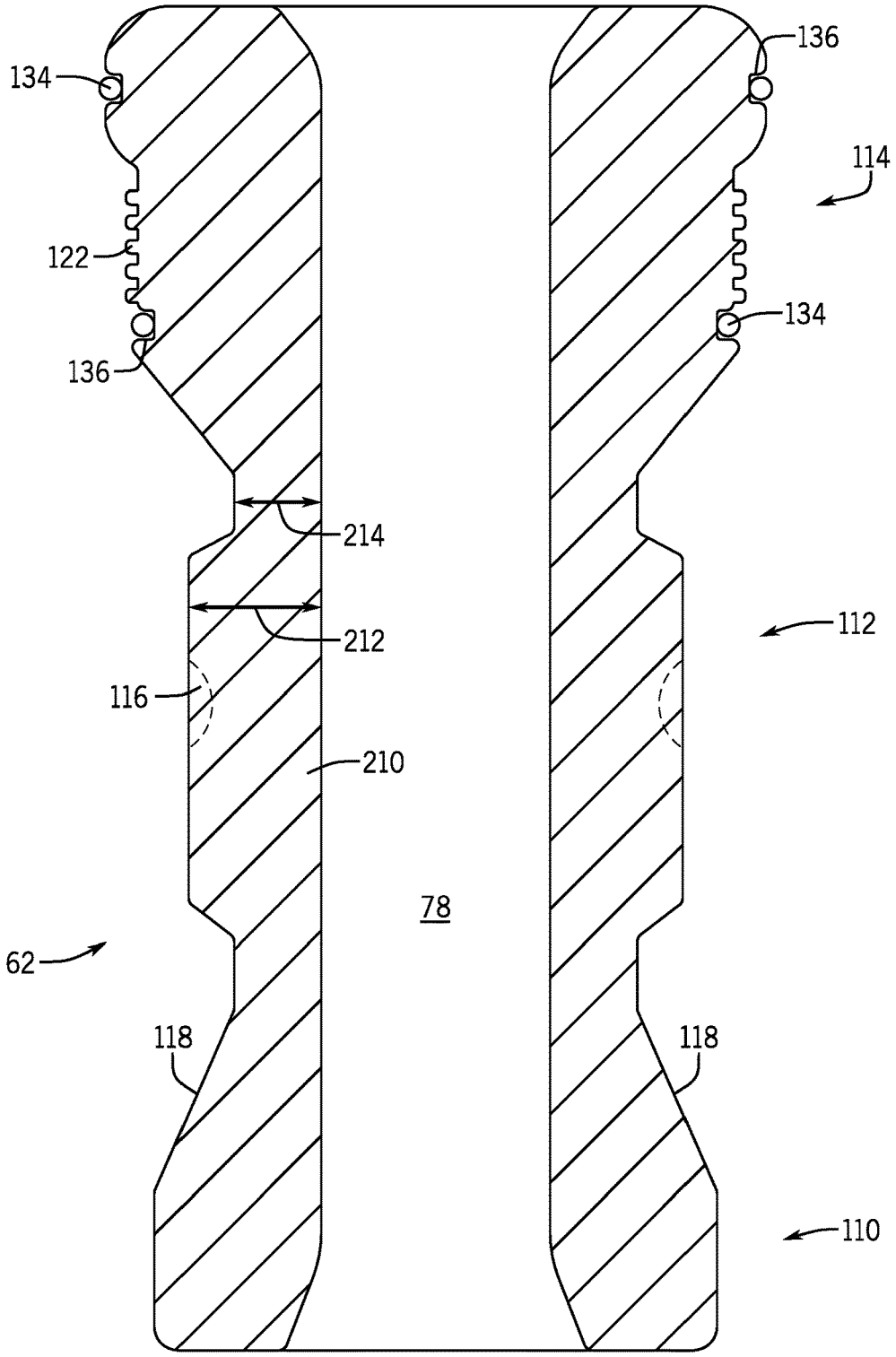
FIG. 6 is a cross-sectional view of an embodiment of an isolation sleeve.

FIG. 6 is a cross-sectional view of an embodiment of an isolation sleeve 62. As explained above, the frac fluid 31 exits the frac passages 68 and directly contacts the second portion 112 of the isolation sleeve 62. In this way, the second portion 112 may experience the greatest wear of the three portions 110, 112, and 114. To compensate for this wear, the second or middle portion 112 may include a frac fluid 31 contact portion 210 (e.g., wear resistance feature) that has a width 212 that is greater than a width 214 of the remaining second portion 114. Accordingly, the portion 210 may increase the life of the isolation sleeve 62 during fracing operations. In some embodiments, the frac fluid 31 contact portion 210 may include wear indicators 116 (e.g., grooves) that enable a user to visually determine the amount of wear experienced by the isolation sleeve 62.

Figure 7:
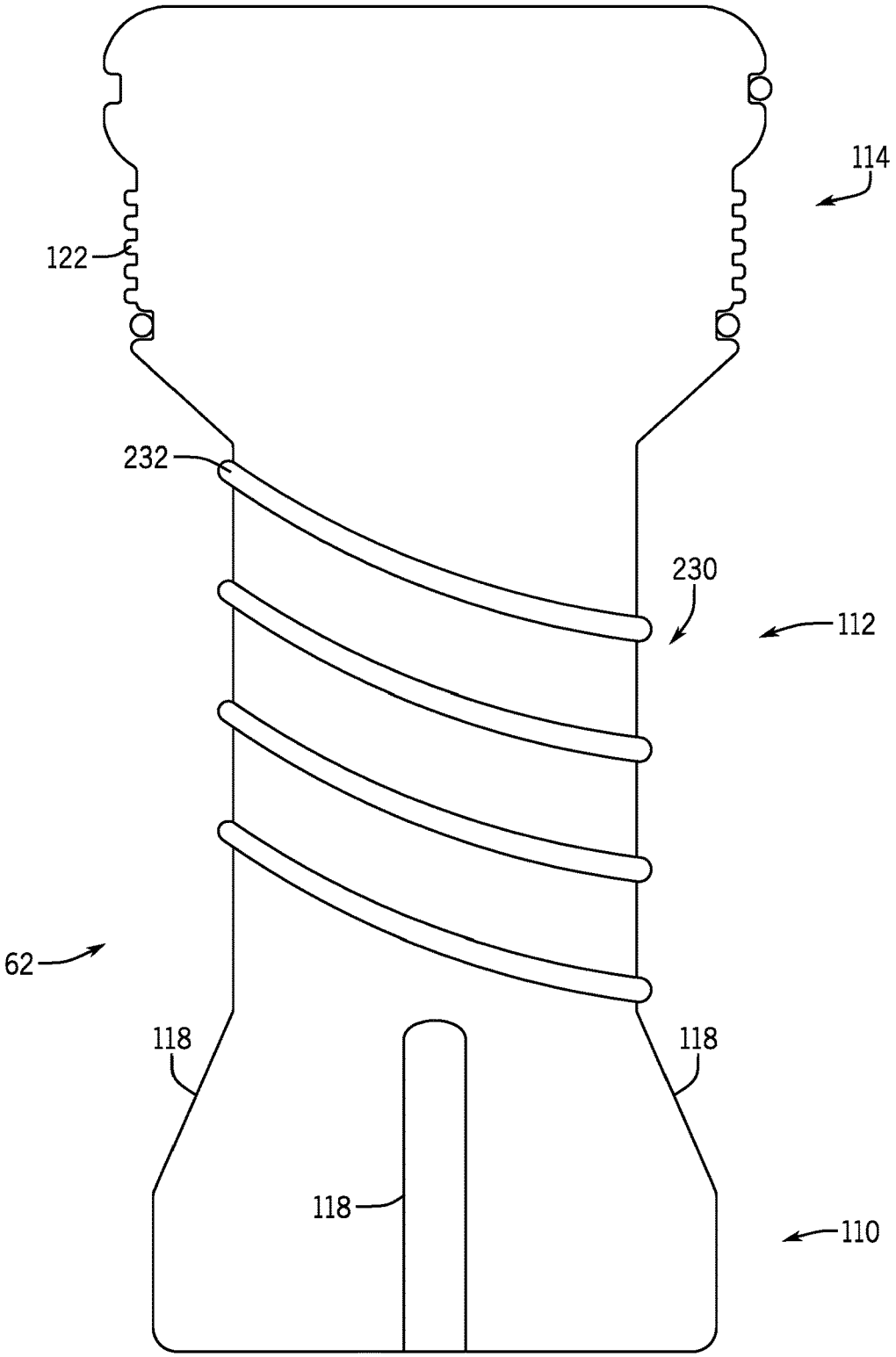
FIG. 7 is a front view of an embodiment of an isolation sleeve.

FIG. 7 is a front view of an embodiment of an isolation sleeve 62. As illustrated, the second portion 112 of the isolation sleeve 62 may include a flow feature 230 (e.g., wear resistance feature). The flow feature 230 may include helical grooves and/or helical protrusions 232 that wrap around the second portion 112. In operation, the flow feature 230 may increase wear resistance by channeling (e.g., swirling) the frac fluid 31 around the isolation sleeve 62 to reduce direct impact between the frac fluid 31 and the isolation sleeve 62.

Figure 8:
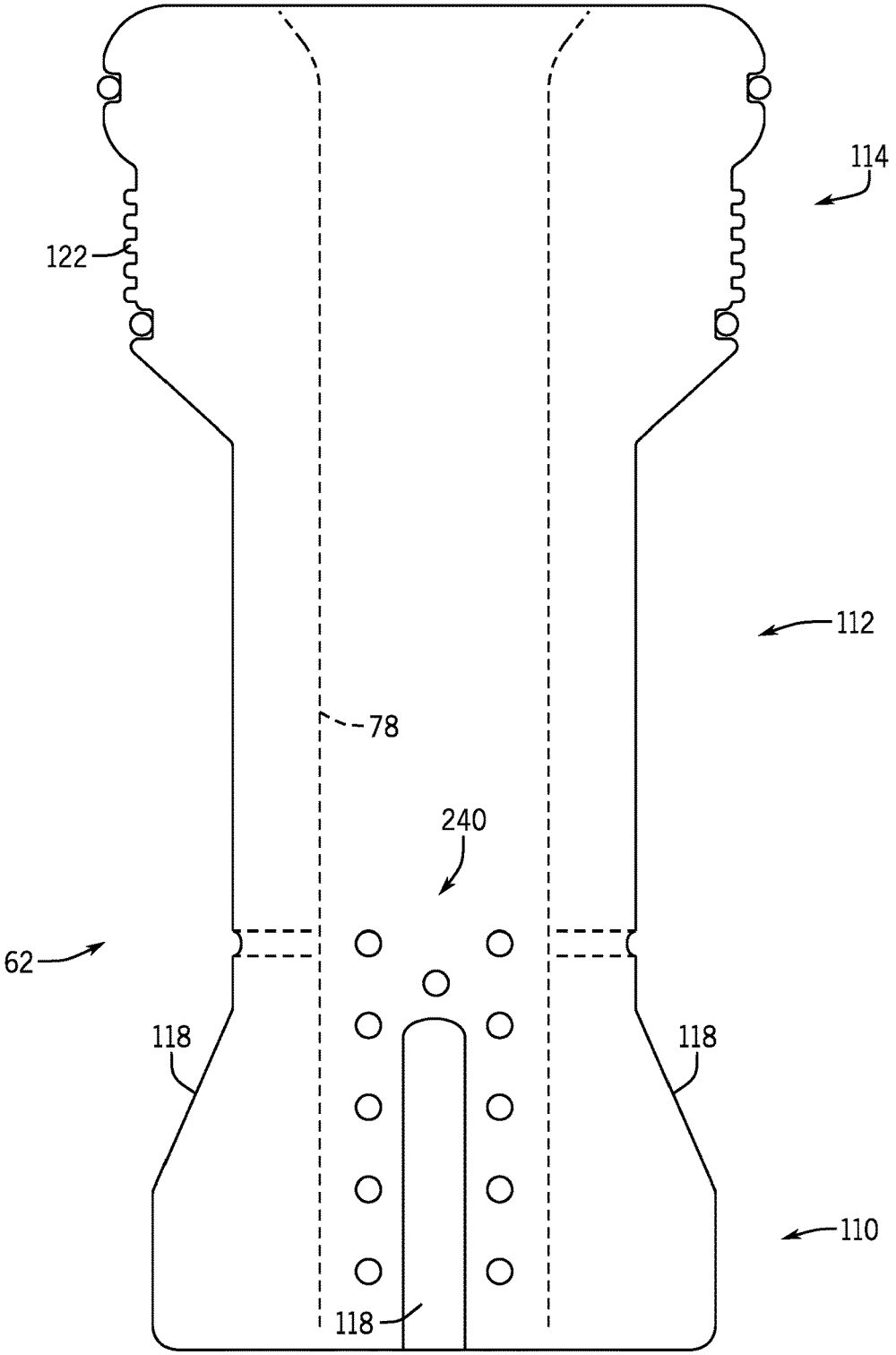
FIG. 8 is a front view of an embodiment of an isolation sleeve.

FIG. 8 is a front view of an embodiment of an isolation sleeve 62. As illustrated, the isolation sleeve 62 may include a plurality of apertures 240 that enable frac fluid 31 to flow through the isolation sleeve 62 and into the passage 78. As frac fluid 31 enters the passage 78 and more quickly fills the annular space between the tubing 28 and the isolation sleeve 62, the isolation sleeve 62 may reduce the boost pressure (e.g., stress) acting on the second and third portions 112 of the isolation sleeve 62.

Figure 9:
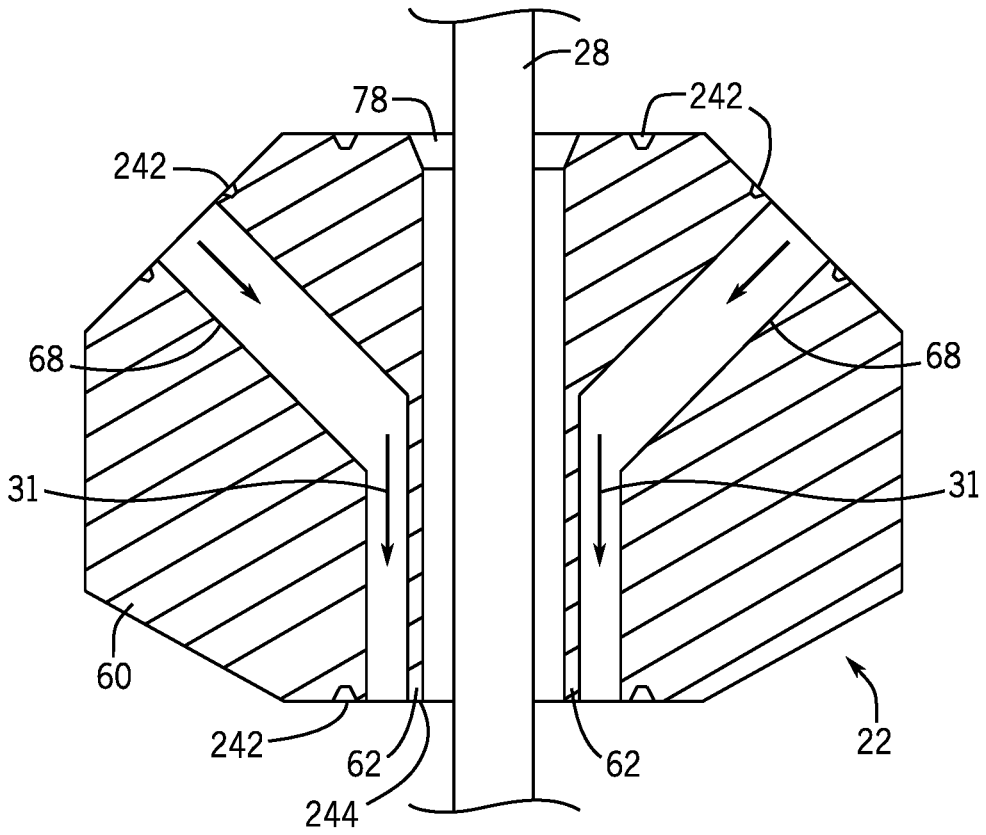
FIG. 9 is a cross-sectional view of an embodiment of a frac head system.

FIG. 9 is a cross-sectional view of an embodiment of a frac head system 22. As illustrated, the frac head 60 and isolation sleeve 62 are one-piece (e.g., integral or formed into a single integral, gaplessly continuous piece). For example, the frac head 60 may be cast as one-piece, machined as one-piece, and/or produced using additive manufacturing processes. By producing the frac head system 22 as one piece, the frac head system 22 may avoid connecting and sealing issues between the isolation sleeve 62 and the frac head 60. As shown, one or more seal grooves 242 (e.g., circumferential) are provided in the one-piece frac head 60 and isolation sleeve 62. For example, the seal grooves 242 may circumferentially surround apertures of the one or more frac passages 68 and may be configured to receive a seal (e.g., circumferential). In the illustrated embodiment, a portion 244 (e.g., a lower portion) of the isolation sleeve 62 is positioned within the corresponding seal groove 242.

Figure 10:
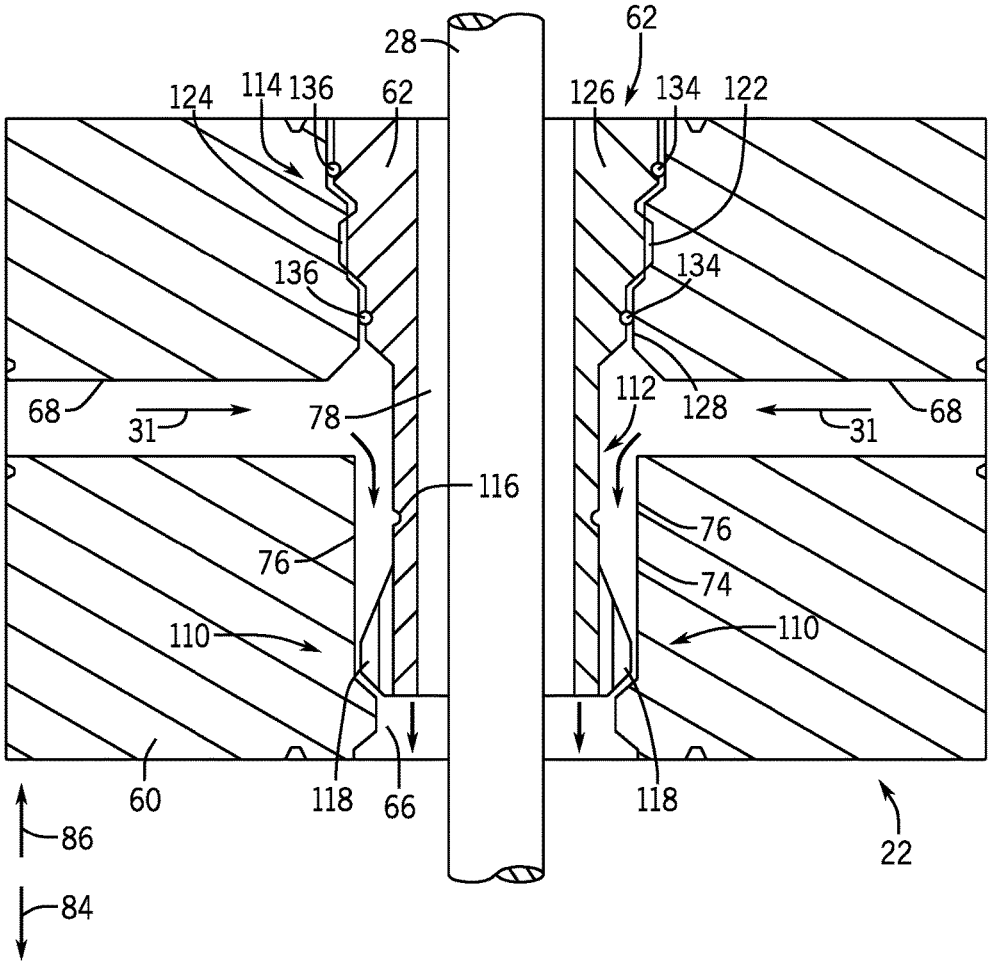
FIG. 10 is a cross-sectional view of an embodiment of a frac head system.

FIG. 10 is a cross-sectional view of an embodiment of a frac head system 22 with an isolation sleeve 62. In the illustrated embodiment, the frac passages 68 are generally orthogonal to the bore 66 of the frac head 60 and the tubing 28. As shown, the middle portion 112 of the isolation sleeve 62 extends over the outlets 76 of the frac passages 68 to block direct contact between the frac fluid 31 and the tubing 28 as the frac fluid 31 exits the frac passages 68.

Figure 11:
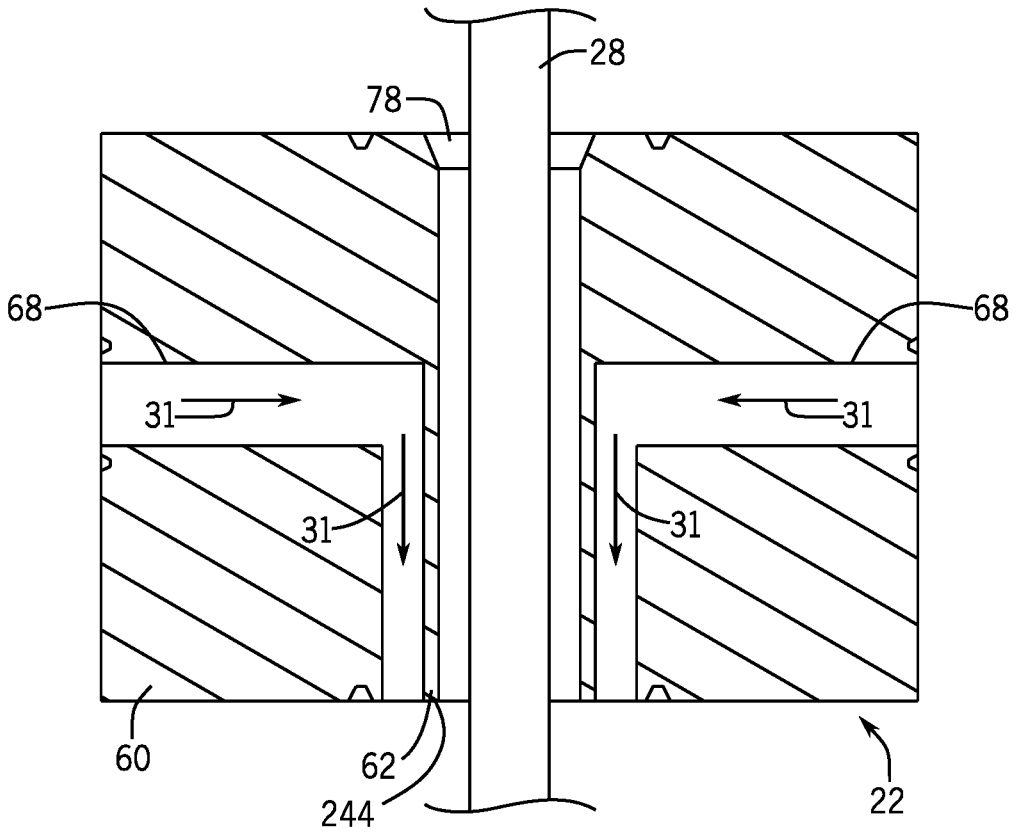
FIG. 11 is a cross-sectional view of an embodiment of a frac head system.

FIG. 11 is a cross-sectional view of an embodiment of a frac head system 22. As illustrated, the frac head 60 and isolation sleeve 62 are one-piece, and the frac passages 68 are generally orthogonal to the bore 66 of the frac head 60 and the tubing 28. The various features disclosed herein may be combined in any suitable manner. For example, the frac head systems 22 illustrated in FIGS. 10 and 11 may include any of the features described above with respect to FIGS. 1-9.

As noted above, to meet consumer and industrial demand for natural resources, companies often invest significant amounts of time and money in finding and extracting hydrocarbons (like oil and natural gas) and other subterranean resources from the earth. Particularly, once a desired subterranean reservoir containing hydrocarbons is discovered, drilling and production systems are often employed to drill and complete a well and to access and extract those hydrocarbons, which are typically found within a particular strata or layer of the earth's surface. These systems may be located onshore or offshore depending on the hydrocarbon reservoir's location.

As noted above, fracking is a process for improving reservoir yield. In short, fracking comprises injecting a stimulant (often a water and sand proppant slurry) at high pressure into the well and reservoir. The pressurized proppant creates fissures (fractures) within the formation defining the reservoir, stimulating the flow of subterranean hydrocarbons up through the well and, ultimately, to the surface for collection.

As noted above, a single well may be "fracked" at multiple locations or stages. One type of multi-stage fracking is called "plug-and-perf" fracking—in which a series of consecutively installed plugs segregate the well into isolated zones, and a perforating gun perforates the well in each zone, giving the well access to the reservoir. For example, once a well is drilled and the production casing is cemented in place, a perforating gun carrying a plug is lowered into the well via a wireline. Firing the gun sets the plug in the well and then perforates the production casing and surrounding cement, providing a flow path from the reservoir into the well. The wireline and perforating gun are then completely removed from the well. Following that, fracking proppant pumped down at high pressure into the well flows into the reservoir through the perforations punched into the well, to fracture the reservoir. Once fracking of a stage is complete, the process is repeated by plugging and perforating the next stage, which is at a higher location in the well. Installation and complete removal of the perforating gun can be a time consuming process, both of which are completed before the introduction of proppant for each stage begins.

Certain embodiments of the present disclosure generally relate to apparatus and methods for retrieving a downhole tool via a conveyance string during a fracking operation. For example, in one embodiment, a plug-and-perf assembly may be retrieved via a conveyance string (e.g., a wireline, coiled tubing, segmented tubing, coated wireline, or the like) concurrently with the fracking proppant (e.g., a fluid, which may include water, chemicals, and/or a proppant, such as sand or ceramics) being pumped into the well. The conveyance string may be partially shielded from the proppant by a sleeve (e.g., annular sleeve) disposed inside a goathead (e.g., frac head) receiving the pressurized proppant. That is, the conveyance string extending vertically through the goathead may be damaged by proppant entering the goathead in at least a partial horizontal direction. The sleeve, however, shields the conveyance string from this pressurized proppant, limiting damage to the conveyance string while it remains in the well as the proppant is injected. Advantageously, this is believed to reduce the operating time for performing a fracking operation (e.g., multi-stage or single-stage fracking operation), as the proppant can be injected while the perforating gun and conveyance string are being "pulled-out-of-hole" and/or reset for the next stage.

While certain embodiments are discussed with reference to a fracking proppant to facilitate discussion, as noted above, it should be appreciated that the system and method may be used with any type of fluid, including any suitable well stimulation fluid with or without proppant, such as water, water with a gel or lubricant, or an acidic fluid (e.g., corrosive fluid that may increase porosity and/or permeability of rock). For example, the sleeve may shield the conveyance string from an acidic fluid that is provided through the goathead to a location below a reservoir rock fracture gradient to avoid fracture of the rock or to a location above the reservoir rock fracture gradient to create fractures to facilitate hydrocarbon flow and extraction. For example, the sleeve may shield the conveyance string from a chemical diverter or diverting agent that may be provided through the goathead to plug or seal (e.g., temporarily block fluid flow through) existing perforations in the casing. The chemical diverter may include any suitable material that is configured to plug the existing perforations and then to degrade over time and/or due to temperature and/or to dissolve in water and/or during oil production, for example. Furthermore, while certain embodiments are discussed with reference to a wireline to facilitate discussion, as noted above, it should be appreciated that the system and method may be used with any suitable conveyance string, including a wireline, a coiled tubing, a segmented tubular, a wireline coated in a friction-reducing material (e.g., having a polytetrafluoroethylene [PTFE] sheath), or the like. Furthermore, while certain embodiments are discussed with reference to multi-stage fracking to facilitate discussion, as noted above, it should be appreciated that the system and method may be used in single-stage fracking operations. Furthermore, while certain embodiments are discussed with reference to a downhole tool that includes a perforating gun to facilitate discussion, it should be appreciated that the system and method may be used with any suitable downhole tool, including sensors configured to monitor conditions within the well (e.g., pressure sensors configured to monitor pressure, temperature sensors configured to monitor temperature, image sensors configured to obtain an image of the well, and/or any of a variety of sensors [e.g., chemical, acoustic, optical, capacitive, or the like) configured to monitor characteristics [e.g., chemical composition, density, or the like) of fluid within the well, or the like). Thus, the disclosed system and method may use the sleeve to shield any of a variety of conveyance strings supporting any of a variety of downhole tools from any fluid that is provided through the goathead, thereby enabling use and/or movement (e.g., insertion or withdrawal) of the downhole tool as the fluid is provided through the goathead, such as during multi-stage or single-stage fracking operations, for example.

Figure 12:
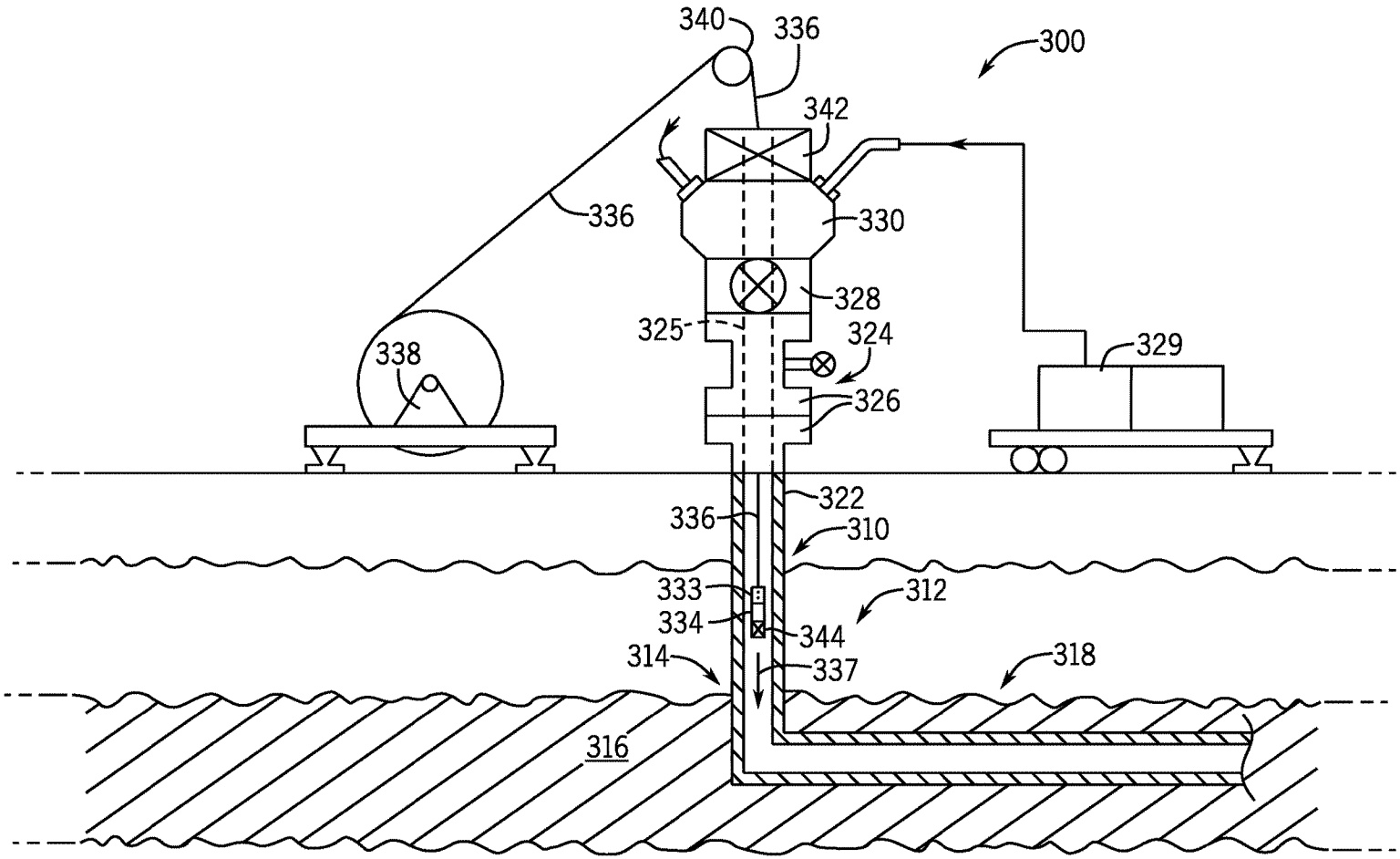
FIG. 12 is a schematic diagram showing insertion of a tool during a multi-stage fracking operation, in accordance with one embodiment of the present disclosure.
Figure 13:
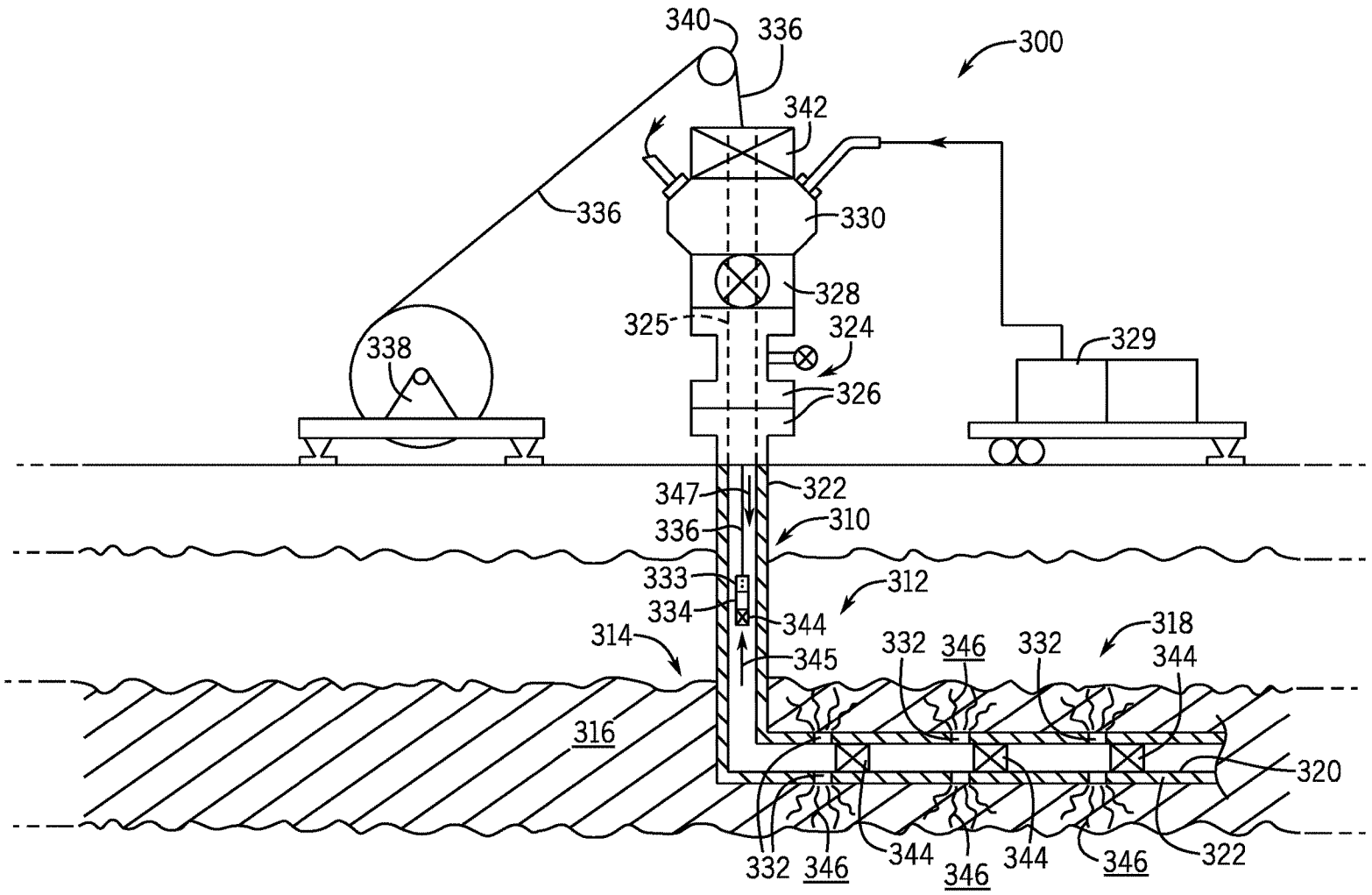
FIG. 13 is a schematic diagram showing withdrawal of the tool of FIG. 1 during the multi-stage fracking operation, in accordance with one embodiment of the present disclosure.

Turning now to the present figures, FIGS. 12 and 13 illustrate a fracking system 300 for a well 312, in accordance with one embodiment. In particular, FIG. 12 is a schematic diagram showing insertion of a tool 310 (e.g., downhole tool or tool assembly having a perforating gun, plug, sensors, or the like) during a multi-stage fracking operation, and FIG.

13 is a schematic diagram showing withdrawal of the tool 310 during a multi-stage fracking operation. As shown, the well 312 has a vertical leg 314 that extends to a subterranean reservoir 316 that, as illustrated, has a much greater horizontal length than vertical depth. To maximize reservoir yield, the well 312 also has a horizontal leg 318, which may extend for thousands of feet. Indeed, the well 312 may have any number of constructions, including the construction shown in FIG. 1, for example, depending on the geological formation, and need not be limited to directly vertical, horizontal, or linear legs.

The illustrated well 312 may be formed by drilling a wellbore and then lining that wellbore with a production casing 320 (e.g., annular casing). A layer of cement 322 is then added to seal the annular space between the exterior surface of the production casing 320 and the earthen walls of the wellbore.

At the surface, an exemplary wellhead assembly 324 facilitates and controls ingress and egress to the well 312. In the illustrated embodiment, one or more spool bodies 326 (e.g., a casing head, tubing head, casing spool, or tubing spool) are provided to support various casing or tubing strings that may extend into the well 312.

The wellhead assembly 324 includes a number of components to control the insertion of fracking proppant (e.g., a fluid, which may include water, chemicals, and/or a proppant, such as sand or ceramics) into the well 312, the components and spool bodies 326 cooperating to form a wellhead bore 325 that aligns with the entrance of the well 312. For example, a frac valve 328—which may be any number of types of valves, including ball valves, gate valves, for example—is coupled to the spool bodies 326 and can be used to isolate the well 312 from a pressurized-proppant source 329, and vice versa. The wellhead assembly 324 also includes a goathead 330 (e.g., a frac head) that can be used to merge pressurized proppant from multiple sources 329 and direct the pressurized proppant into the wellhead bore 325 and the well 312.

However, before the proppant is injected into the well 312, the well 312 may be perforated. As shown in FIG. 13, perforations 332 (e.g., holes) are punched into the casing 320 and surrounding cement 322, creating a fluid pathway between the well 312 and the reservoir 316. This can be accomplished, for example, with the tool 310, which may have a perforating gun 333 carried by a setting tool 334 and a wireline 336 (e.g., conveyance string). In the illustrated embodiment, a wireline source 338 feeds wireline 336, which may be thousands of feet long, into the well 312. The wireline 336 is a conveyance tool that can send electrical, acoustic, optical or mechanical signals to activate/operate the attached setting tool 334 and perforating gun 333, for example. The system 300 may include a supported pulley 340 that guides the wireline 336 through a top valve 342 of the wellhead assembly 324.

In operation, the tool 310 may be lowered into the well 312, as shown by arrow 337 in FIG. 12. In some embodiments, to drive the setting tool 334 downhole into the well 312, fluid, generally just above wellbore pressure is pumped into the well 312. This carries the setting tool 334 down to a desired location in the well 312. Once the desired location is reached, the wireline 336 is prevented (e.g., blocked) from further unspooling, fixing the location of the setting tool 334 within the well 312.

At this point, a signal providing operating instructions is sent from the surface to the setting tool 334 via the wireline 336. By way of example, the signal may instruct a plug 344 (e.g., radially-expandable plug) coupled to the setting tool 334 to expand and set to seal off the well 312 below it (e.g., downstream of the plug 344). The signal may also trigger the perforating gun 333, causing explosively charged projectiles to puncture or punch through the casing 320 and surrounding cement 322, creating the perforations 332 that permit fluid to flow between the reservoir 316 and the well 312, as shown in FIG. 13.

In certain traditional systems, the wireline 336 and the setting tool 334 undergo a "pull-out-of-hole" operation—i.e., the wireline 336 and setting tool 334 are retrieved (e.g., fully removed or withdrawn) out of the well 312—after formation of the perforations 332 and before fracking proppant is introduced into the well 312. But retrieval can be a time consuming process, as there may be thousands of feet of wireline 336 in the well 312. In such traditional systems, once the wireline 336 and setting tool 334 are retrieved, fracking proppant is pressurized at the source 329, sent to the goathead 330, and directed into the well 312 and through the perforations 332 to create fissures 346 in the formation. In such traditional systems, the process (i.e., inserting the tool 310, placing the plug 344, creating the perforations 332, completely retrieving the tool 310, and subsequently providing the proppant) may then be repeated for each stage (e.g., location within the well 312) 334. However, the plug 344 is set and perforations 332 are punched at a higher point in the well 312 each time—the more recently set plug 344 isolating the previously fracked section or stage below it.

The exemplary embodiment, however, facilitates withdrawal or retrieval of the wireline 336 and the setting tool 334, as shown by arrow 345 in FIG. 13, concurrently (e.g., simultaneously or at the same time) with injection of fracking proppant into the well 312, as shown by arrow 347 in FIG. 13. For example, the wireline 336 and the setting tool 334 are pumped (e.g., driven), typically at a relatively low pressure, down to the desired location, and a signal is sent to fire the perforating gun 333 and to set the plug 344. However, the fracking proppant may be injected into the well 312 before the pull-out-of-hole operation for the wireline 336 and the setting tool 334 is complete—that is, while the setting tool 334 and the wireline 336 are still in the well 312 (e.g., positioned within and/or moving within the well 312). In some embodiments, as shown in FIG. 13, respective plugs 344 may be set and respective perforations 332 may be created at multiple stages using the disclosed techniques. This is believed to save considerable time and reduce the cost of operating equipment and/or personnel necessary to complete the fracking operation (e.g., single-stage or multi-stage fracking operation).

Figure 14:
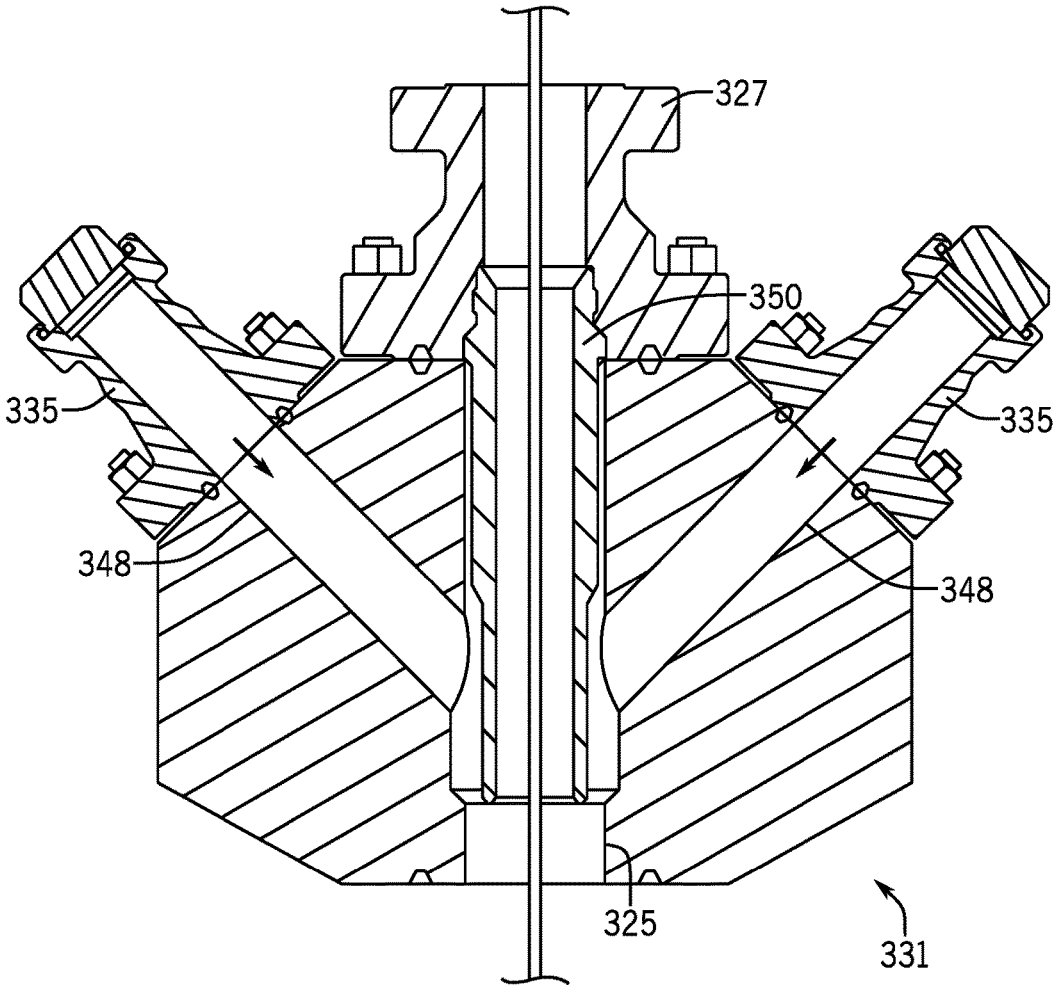
FIG. 14 is a cross-sectional schematic of an isolation sleeve inserted within a goathead to at least partially protect a wireline, in accordance with one embodiment of the present disclosure.

FIG. 14 illustrates an exemplary device that facilitates this concurrent operation. Specifically, FIG. 14 illustrates an embodiment of a goathead assembly 31 (e.g., frac head system) having the goathead 330 with a series of inlets 348 that receive pressurized proppant from the proppant source 329. The illustrated inlets 348 are arranged at a 45 degree angle (e.g., relative to a central or axial axis of the wellhead bore 325), but other arrangements, including completely horizontal arrangements (e.g., perpendicular to a central or axial axis of the wellhead bore 325), are envisaged. The inlets 348 provide passageways for the pressurized proppant to enter the wellhead bore 325 of the wellhead assembly 324. As shown, the goathead assembly 331 also includes an adapter spool 227 and connectors 335 that are configured to couple to conduits that extend to the proppant source 329.

Pressurized proppant exiting the inlets 348 to go downhole into the well 312 impact an isolation sleeve 350 (e.g., annular sleeve) surrounding (e.g., circumferentially surrounding) at least a portion of the wireline 336. This protects the wireline 336 from the abrasive turbulence caused by the insertion of the proppant into the goathead 330—abrasive turbulence which increases the chances of shearing or otherwise damaging the wireline 336. The wireline 336 is exposed to the proppant below this isolation sleeve 350; however, it is believed that this proppant will have a more laminar flow and, thus, be less likely to damage the wireline 336. Indeed, the proppant exiting the inlets 348 is at a relatively high-velocity. By shielding the wireline 336 from the proppant as it introduced into the wellhead bore 325, the wireline 336 can remain in the well 312 and be retrieved while fracking proppant is injected into the well 312.

Retrieval of the wireline 336 concurrent with injecting of fracking proppant is believed to provide a number of advantages. For example, it reduces the time between when the perforations 332 are made and fracking proppant is injected into the well 312, decreasing the likelihood of unwanted perforation closure that could damage the well 312. It also increases the number of fracking stages that can be completed in a day, which can reduce the number of days necessary for the fracking operations and, in turn, reduce the operating costs for performing the fracking. Put simply, it allows the injection of fracking proppant into the well 312 at a relatively short time after a given stage of the well 312 has been plugged and perforated.

The isolation sleeve 350 may be a separate, retrievable piece (e.g., coupled to and/or held in place relative to the goathead 330 via fasteners, threads, flanges, or the like), or it may be integrated into the goathead 330 (e.g., integrally formed with the goathead 330, thereby forming a one-piece structure), or other spool body that is the inlet for the fracking proppant. It should be appreciated that the isolation sleeve 350 and the goathead 330 may have any of a variety of configurations that enable the isolation sleeve 350 to block contact between the proppant flowing into the wellhead bore 325 and the wireline 336 and/or to facilitate injection of fluid to drive the downhole tool 310 into the well 312 and/or injection of the proppant while the wireline 336 is positioned within and/or moves through the wellhead bore 325.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. For example, the frac head 60 and the isolation sleeve 62, as well as any other components shown and described with respect to FIGS. 1-11, may be utilized in combination with the components and the techniques described with respect to FIGS. 12-14. For example, it should be understood that the goathead assembly 31 may have any of the features of the frac head system 22 illustrated in FIGS. 1-11, and the sleeve 350 illustrated in FIGS. 12-14 may have any of the features of the isolation sleeve 62 illustrated in FIGS. 2-11. Again, the brief summary presented above is intended only to familiarize the reader with certain aspects and contexts of some embodiments without limitation to the claimed subject matter.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method for fracking a well, comprising:

inserting a downhole tool into the well via a conveyance string through a wellhead assembly having a wellhead bore;

surrounding, at least partially, the conveyance string with a sleeve that at least extends below a portion of an inlet of the wellhead assembly, wherein the inlet intersects the wellhead bore and the sleeve comprises a plurality of protrusions that extend radially-outwardly and that are spaced apart about a circumference of the sleeve to define flutes; and injecting a first pressurized fluid into the well via the inlet of the wellhead assembly and through the flutes of the sleeve while retrieving the downhole tool from the well.

2. The method of claim 1, wherein the inlet comprises a non-vertical inlet relative to a central axis of the wellhead bore.

3. The method of claim 1, comprising inserting the downhole tool to a desired location within the well while injecting a second pressurized fluid into the well via the inlet.

4. The method of claim 1, comprising inserting the downhole tool to a desired location within the well and injecting a second pressurized fluid into the well while the downhole tool is stationary at the desired location.

5. The method of claim 1, wherein the sleeve is an annular sleeve that circumferentially surrounds the conveyance string.

6. The method of claim 1, wherein the sleeve is coupled to the wellhead assembly.

7. The method of claim 1, wherein the sleeve is integrally formed with the wellhead assembly.

8. The method of claim 1, comprising perforating a casing that lines the well at multiple stages using the downhole tool.

9. The method of claim 1, wherein retrieving the downhole tool from the well comprises moving the downhole tool from a first position within the well proximate to a formation from which a resource is extracted to a second position within the well proximate to the wellhead assembly.

10. A method for fracking a well, comprising:

inserting a downhole tool into the well via a conveyance string through an annular sleeve integrally formed with a goathead of a wellhead assembly, wherein the annular sleeve extends axially across an inlet of the goathead; and injecting pressurized fluid into the well via the inlet of the goathead and blocking contact between the pressurized fluid and a portion of the conveyance string via the annular sleeve while the downhole tool is positioned within the well.

11. The method of claim 10, wherein the inlet is oriented at an angle of approximately 45 degrees relative to a central axis of the wellhead bore.

12. The method of claim 10, comprising injecting the pressurized fluid into the well via the inlet while the downhole tool is moving through the well.

13. The method of claim 10, comprising injecting the pressurized fluid into the well via the inlet while the downhole tool is stationary within the well.

14. The method of claim 10, wherein the pressurized fluid comprises a fracking proppant, a diverting agent, or any combination thereof.

15. The method of claim 10, comprising perforating a casing that lines the well at multiple stages using the downhole tool.

16. The method of claim 10, wherein injecting the pressurized fluid into the well via the inlet of the goathead comprises flowing the pressurized fluid through the inlet, then through a flute defined between adjacent protrusions that extend radially between a radially-outer wall of the annular sleeve and a radially-inner wall of the goathead, and then into the well.

17. A system for fracking a well, comprising:

a wellhead assembly comprising a goathead, the goathead comprising an inlet and a bore that are non-parallel to one another, wherein the goathead is configured to receive pressurized fluid at the inlet and to direct the pressurized fluid through an outlet of the bore toward the well;

an isolation sleeve located in the bore, wherein the isolation sleeve extends axially from a first end portion proximate to the outlet of the bore to a second end portion distal from the outlet of the bore, the isolation sleeve extends axially below at least a top portion of the inlet where the inlet and bore intersect, and the first end portion is coupled to a radially-inner wall of the goathead that defines the bore via one or more fasteners; and a wireline coupled to a downhole tool and configured to move within the bore as the pressurized fluid flows into the bore via the inlet.

18. The system of claim 17, wherein the sleeve is an annular sleeve that circumferentially surrounds the wireline, and the isolation sleeve is configured to block contact between the wireline and the pressurized fluid exiting the inlet into the bore.

19. The system of claim 17, wherein the downhole tool comprises a perforating gun that is configured to perforate a casing that lines the well, a sensor that is configured to monitor a condition of the well, or a combination thereof.

20. The system of claim 17, wherein the first end portion is coupled to the goathead via a threaded interface, one or more fasteners, engagement between a lip of the isolation sleeve and a landing of the wellhead assembly, or a combination thereof.

* * * * *